US005500960A

United States Patent [19]

Tagg

[11] Patent Number: 5,500,960

[45] Date of Patent: Mar. 26, 1996

[54] FLUSH SYSTEM FOR OUTDOOR PORTABLE TOILETS

[75] Inventor: Richard L. Tagg, Sandhutton, England

[73] Assignee: Poly-John Enterprises Corporation, Whiting, Ind.

[21] Appl. No.: 380,681

[22] Filed: Jan. 30, 1995

[51] Int. Cl.[6] ..... E03D 1/00

[52] U.S. Cl. ..... 4/318; 4/321; 4/460

[58] Field of Search ..... 4/317, 318, 321, 4/322, 323, 449, 450, 460, 462, 463, 476–479, 483

[56] References Cited

U.S. PATENT DOCUMENTS

| | | | |
|---|---|---|---|
| 3,601,821 | 8/1971 | Corsiglia | 4/323 X |
| 3,662,888 | 5/1972 | Kemper | 4/318 X |
| 3,860,974 | 1/1975 | De Vries | 4/317 X |
| 4,504,983 | 3/1985 | Goodyer | 4/460 X |

FOREIGN PATENT DOCUMENTS

| | | | |
|---|---|---|---|
| 0218780 | 4/1987 | European Pat. Off. | 4/460 |
| 4213637 | 8/1992 | Japan | 4/460 |

*Primary Examiner*—Charles E. Phillips
*Attorney, Agent, or Firm*—Harness, Dickey & Pierce

[57] ABSTRACT

A flushing system is provided for an outdoor portable toilet of the type having a cabana containing a waste material storage tank upon which a toilet structure is positioned for the deposit of toilet waste material into the tank by gravity. A separate fresh water tank is removably positioned outside the cabana against its rear wall and is connected, through a pipe, to a control valve, which, in turn, is connected to a flushing mechanism and a pump which conveys liquid to the flushing mechanism when actuated. In addition, a waste tank pipe extends into the waste tank and a filter through which waste liquid may be drawn from the waste tank to the valve and then pumped to the flushing mechanism. The valve may be set to draw liquid either from the fresh water tank or the liquid from the waste water holding tank or, alternatively, from neither tank, so that the unit may be operated without flushing. The water holding capacity of the fresh water tank is less than the pre-determined waste holding capacity of the waste water holding tank to preclude overfilling the waste tank. Thus, the waste tank may be emptied and the fresh water tank filled when the cabana is periodically serviced.

10 Claims, 8 Drawing Sheets

FIG-1
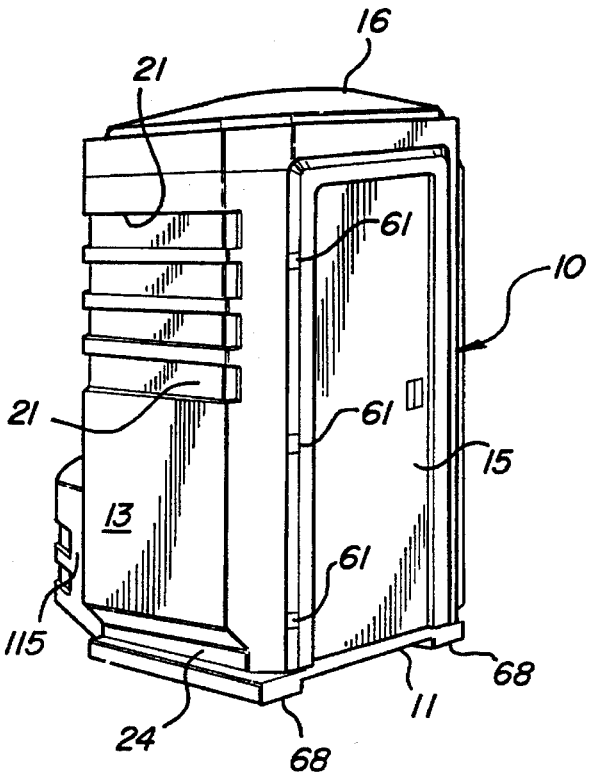
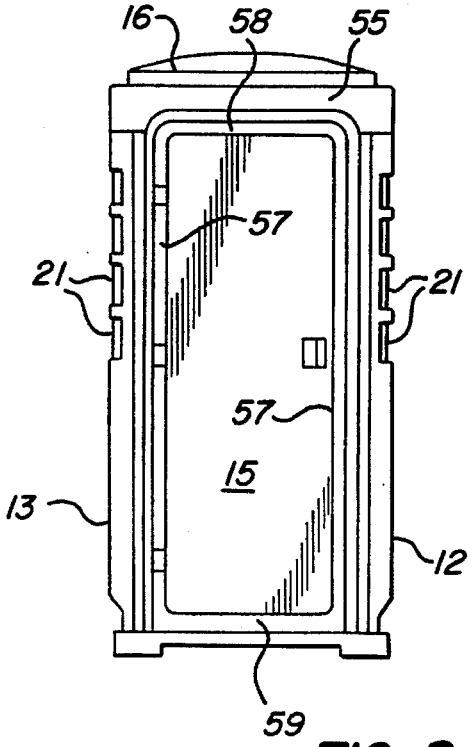
FIG-2
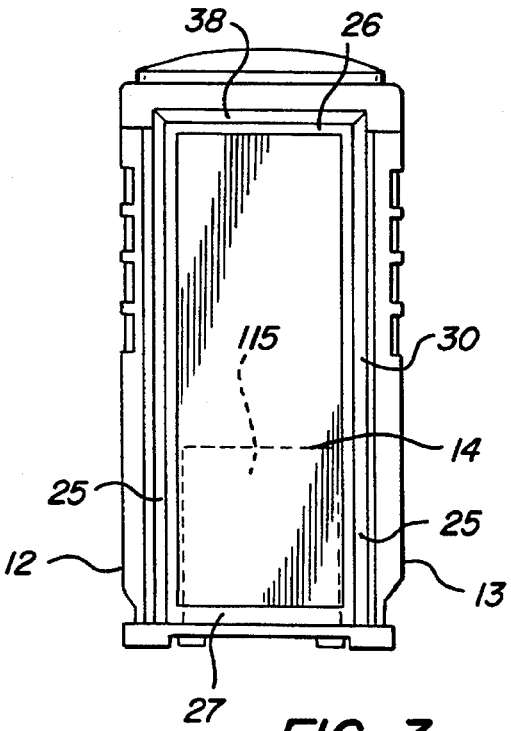
FIG-3
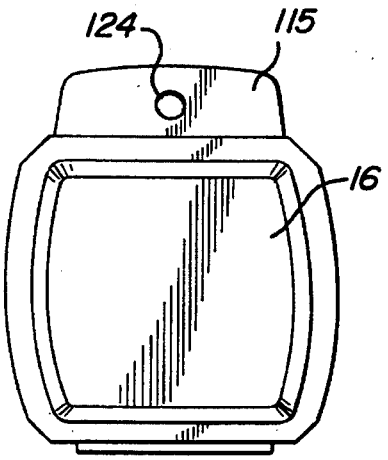
FIG-4

FIG-6
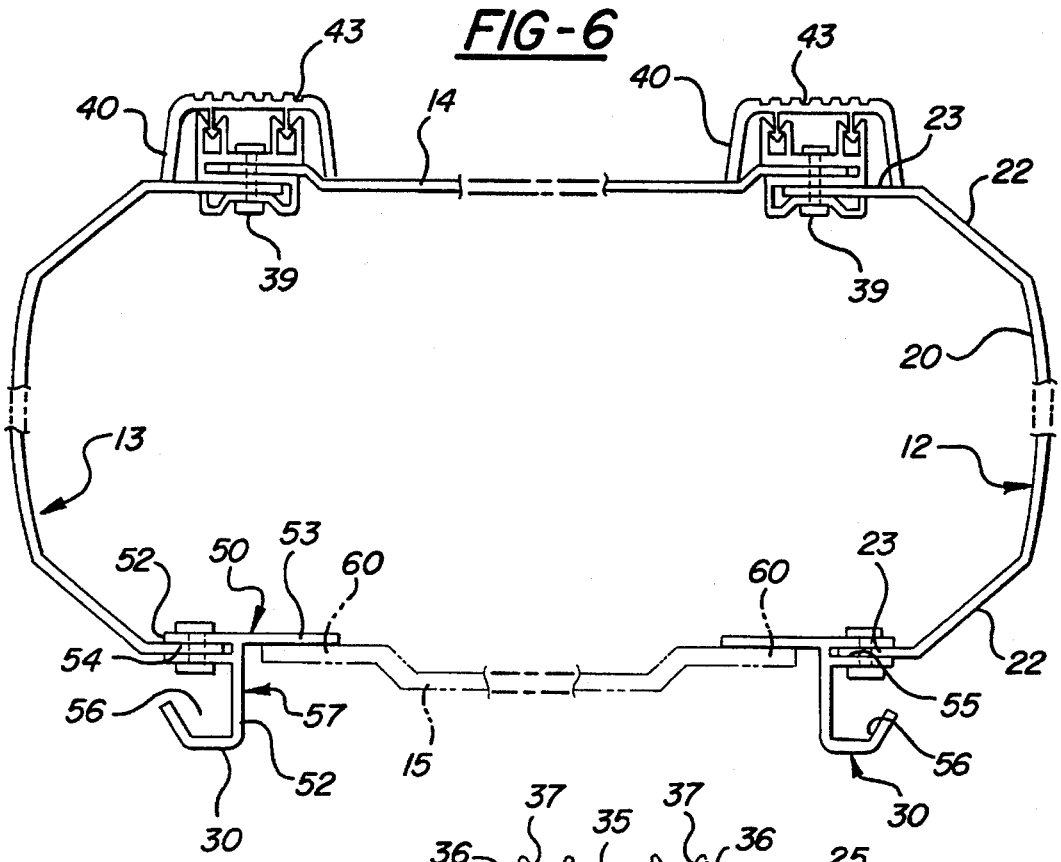
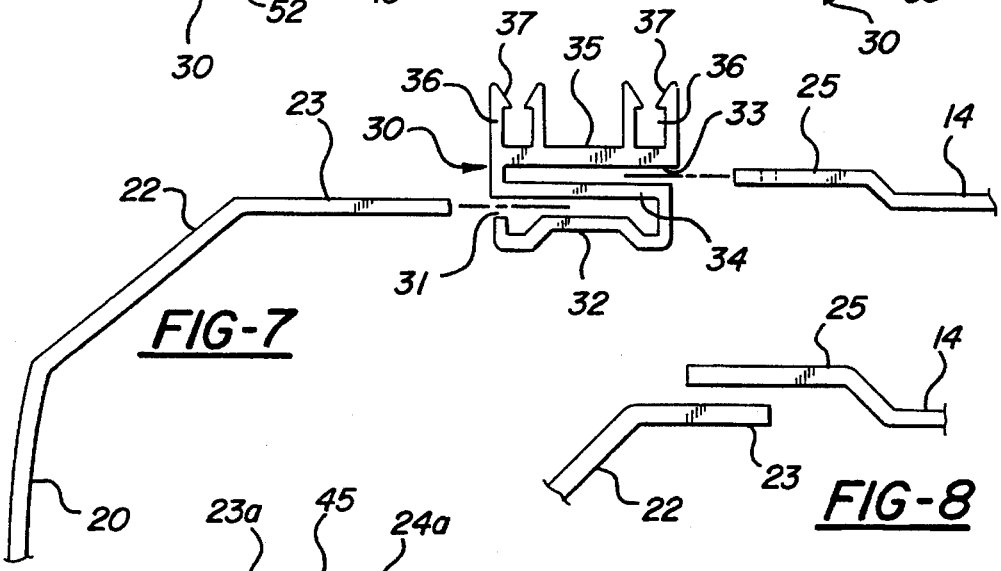
FIG-7
FIG-8
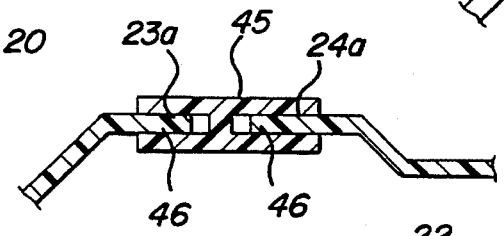
FIG-9
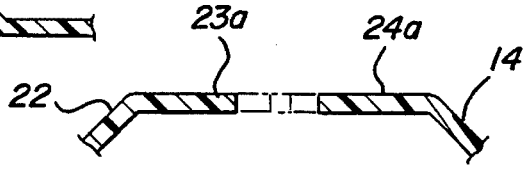
FIG-10

FLUSH SYSTEM FOR OUTDOOR PORTABLE TOILETS

BACKGROUND OF INVENTION

This invention relates to the provision of an optional flush system in a portable, outdoor-type toilet system. Conventional portable or transportable toilet units, such as those used at construction sites, outdoor public events and the like, generally comprise a cabana or a housing within which a toilet waste material storage tank is positioned. A toilet structure is formed upon the top of the tank and opens into the tank for gravity collection of toilet waste material and subsequent removal of accumulations of that material from the tank.

Usually such cabanas are made of large sheets of plastic materials which are formed into rear and side walls and a front wall having a doorway and a suitable door, a roof and a floor.

The waste material holding tank which is also formed of plastic material, is normally positioned within the cabana and occupies roughly one half of the floor space of the cabana. The toilet waste material drops, under the influence of gravity, into the tank where it is accumulated for ultimate collection, Typically, the accumulated waste within the holding tank is removed, from time to time, by inserting a pipe, through the toilet opening, into the tank and pumping the accumulated waste material into a suitable tank-truck for removal of the waste to a waste disposal and processing center.

Examples of such types of known portable toilet units are disclosed in U.S. Pat. No. 3,447,167 issued Jun. 3, 1969 to David B. Harding for a "Portable Toilet Cabana"; U.S. Pat. No. 3,835,480 issued Sep. 17, 1974 to George W. Harding for a "Chemical Toilet Cabana"; U.S. Pat. No. 4,031,572 issued Jun. 28, 1977 to George W. Harding for a "Chemical Toilet Cabana Shell Section"; U.S. Pat. No. 4,577,351 issued Mar. 25, 1986 to George W. Harding for a "Portable Toilet Cabana"; U.S. Pat. No. 4,831,671 issued May 23, 1989 to George W. Harding for a "Portable Toilet Cabana"; U.S. Pat. No. 4,918,765 issued Apr. 24, 1990 to George W. Harding for a "Portable Toilet Cabana"; and U.S. Pat. No. 3,435,464 issued Apr. 1, 1969 to David B. Harding for a "Portable Toilet." In each of these examples of portable toilet constructions, toilet waste material is deposited by gravity and held within the waste storage tanks until that material is removed from time to time during servicing of the unit.

Although toilet units of the general types disclosed in the foregoing patents are satisfactory for their purposes, the public has become accustomed to the use of indoor flush-type toilets, so that flush-type toilets would be more desirable for outdoor circumstances. Hush toilet systems are more sanitary, less unsightly and usually do not produce as much offensive odors as do static or non-flush toilets. Thus, it would be desirable to provide flush systems for outdoor toilets where feasible. But, flush-type toilets require flushing water or other liquid which generally are unavailable at outdoor sites, such as construction sites, public parade or other public event sites. Thus, water has to be brought to and stored at the unit for use when needed. This has been impractical because typical toilet units have insufficient room and the cabanas are not constructed in a way which enables the storage, within the cabana, of any considerable amount of water for flushing purposes. Moreover, the provision of a pre-determined amount of flushing water would present a problem where that amount of water is used before the toilet unit is restocked with a fresh supply of water. Hence, it would be desirable to having a flushing system which can be optionally used and which has the ability to store a substantial amount of fresh water or other liquid without substantially changing the construction of the toilet cabana. The invention of the present application addresses these problems and provides an improved outdoor toilet unit with an optional flushing system. Further disclosures of preferred embodiments of this invention are made in copending applications identified as U.S. Ser. No. 08/380,680, filed Jan. 30, 1995 and U.S. Ser. No. 08/380,683, filed Jan. 30, 1995 which disclosures are incorporated herein by reference.

SUMMARY OF INVENTION

This invention contemplates a portable toilet unit which may comprise a conventional cabana construction within which a waste holding storage tank, having a toilet structure formed on its upper surface, is mounted. However, a flushing mechanism is provided for the toilet structure and liquid for flushing purposes is provided in one or two ways. First, a separate, removable, fresh water holding tank is arranged outside of, and at the rear surface of, the cabana for providing a supply of fresh water. This water supply tank has a lesser capacity than the pre-determined capacity of the waste holding tank to avoid overfilling or spilling of the waste holding tank contents. The fresh water supply tank can be coupled to a pipe system through which water can be drawn by a manually actuated pump, located within the cabana at the front of the waste holding tank. The water is conveyed through a control valve to a flush mechanism within the toilet structure so that the toilet may be flushed whenever it is used.

Second, as an alternative to the fresh flushing water, a pipe may be run into the waste material holding tank, with the pipe connected to a suitable filter, so that filtered waste liquid in the waste material holding tank may be drawn through the pipe and through the control valve to the flushing mechanism when the pump is actuated. In this case, the control valve may be set to draw liquid from the waste material tank instead of from the fresh water holding tank. The control valve can be set to open either pipe to the flush mechanism or, to close off both pipes, so that the flush mechanism is disabled. In this manner, the toilet unit may be used in any one of three ways, that is: with a fresh water flush; a recycled waste liquid flush; or, as a static, no-flush system.

The particular structure of the flushing mechanism can be conventional, utilizing available flushing devices currently used in toilet facilities. Thus, the construction of the specific flushing mechanism utilized is not part of this invention.

Whenever the unit is serviced, that is, whenever the accumulated waste contents of the holding tank are removed as by pumping the waste material through an inserted pipe into a tank-truck, fresh water may be added to the fresh water holding tank through an opening in the tank. That opening is accessible from the outside of the cabana.

This arrangement lends considerable versatility to the toilet and, particularly, is useful where the toilet unit may not be promptly serviced or is excessively used during a short time period so that it runs out of its fresh water supply and, therefore, remains without a fresh water supply for some time, while still being used as a toilet. Moreover, in cases where the bringing fresh water to the unit is not economically feasible, the fresh water tank can be removed or not installed. Therefore, flushing, to the extent desired, can be accomplished either through the use of the filtered waste liquid from the waste material holding tank or, flushing can be entirely omitted. Significantly, the arrangement precludes overfilling the waste material holding tank.

An object of this invention is to provide an economical easy to use and easy to service system for enabling the flushing of outdoor portable toilet units, including permitting continued flushing even after the fresh water flush capacity is exhausted or, alternatively, enabling the use of the unit without flushing at all, where desired.

A further object of this invention is to provide a portable toilet unit which is of relatively simple construction, is inexpensive to manufacture and to service and is easy to transport and, yet, serves a dual purpose as either a flush or non-flush outdoor toilet unit, depending upon the circumstances and needs.

Another object of this invention is to provide a portable outdoor toilet unit with a supply of fresh water for flushing purposes, without encroaching upon the limited space within the toilet cabana, that is, without the need to install, space-using tanks or other parts within the cabana, in order to make the needed water available.

Still another object of this invention is to provide a water tank for providing fresh water for toilet flushing purposes, which tank is easily removable and replaceable, in the event of damage, and is easily refillable, when needed or during normal servicing and cleaning of the toilet unit and which tank does not diminish the usable space within a cabana.

An additional object is to provide a fresh water storage tank for use with an outdoor portable toilet cabana unit which tank is constructed in a manner that enables it to be easily moved into position against and connected to the cabana and its interior storage tank and toilet structure and which includes a mounting system which holds the tank on the outside of the cabana.

These and other objects and advantages of this invention will become apparent upon reading the following description, of which the attached drawings form a part.

DESCRIPTION OF DRAWINGS

FIG. 1 is a perspective front and side view of the cabana with the water tank.

FIG. 2 is a front, elevational view of the cabana.

FIG. 3 is a rear, elevational view of the cabana showing the water tank in dotted lines.

FIG. 4 is a top, plan view of the cabana and the water tank.

FIG. 6 is an enlarged, partially fragmentary, view of a cross-section of the cabana showing the connections between the side and rear walls thereof.

FIG. 7 is an enlarged, cross-sectional view illustrating the rear wall and side wall connector strip with the adjacent wall sections positioned for insertion in the connector strip channels.

FIG. 8 is a schematic, enlarged view showing the overlapping relationship of the rear and side wall flanges.

FIG. 9 illustrates a modification of the connector strip in which the side and rear wall edge flanges are arranged edge to edge, rather than overlapped.

FIG. 10 is an enlarged, fragmentary view showing the aligned flanges of the modification of FIG. 9.

DETAILED DESCRIPTION

Figure 5:
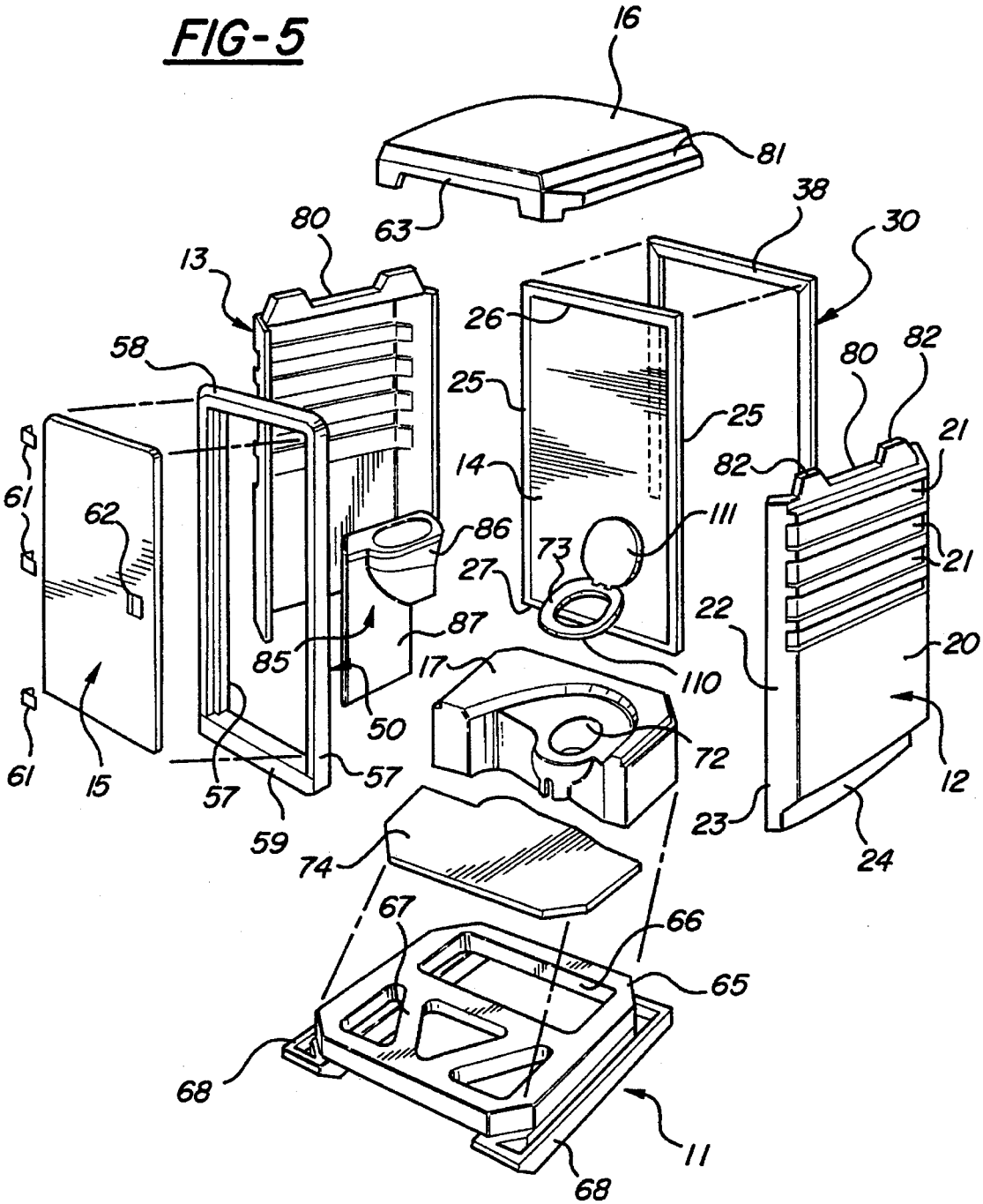
FIG. 5 is an exploded or disassembled view of the major parts of the cabana and toilet.

As shown in the drawings, the cabana 10 includes a base or pallet 11, opposing side walls 12 and 13, a rear wall 14, a door 15 and a roof 16. A combined toilet and waste material tank 17 is positioned in the cabana. Each of these components will be separately described before describing the flush system.

The side walls 12 and 13, preferably, are mirror images of each other. That is, they are made out of a single thermoformed plastic sheet element which is symmetrically formed. Therefore, they can be reversely arranged to form either a left or right side of the cabana. The side walls have a large panel face 20 which is substantially flat. Preferably, rather than forming the panel face 20 truly planar, it is bowed outwardly a small amount. Also, the panel is formed with a series of indentations or channel-like depressions 21 which provide a decorative appearance as well as serve to rigidify the panels.

The opposite corners of each side wall are bent into corner sections 22. These sections may be angled, such as about 45°, to the panel face 20. The free edges of the corner sections are bent into vertical, side edge flanges 23. These side edge flanges are approximately perpendicular to the plane of the panel face 20 so that the corresponding side edge flanges 23 at the rear of both side panels extend toward each other in substantially the same plane. Likewise, the side edge flanges at the forward portion of the cabana, that is, where the door and doorway are located, also extend towards each other and are substantially in the same plane. The lower edges of the side walls 12 and 13 are each provided with a lower edge, horizontally extending flange 24.

The cabana rear wall 14 is provided with opposite side flanges or edge strip portions 25. Similarly, the upper edge of the rear wall 14 is formed with an upper flange or strip portion 26. A lower flange or strip portion 27 is formed on the lower edge of the rear wall.

The adjacent rear wall side flanges and side wall edge flanges are connected together by means of a connector strip 30. Preferably, the connector strip is formed of an extruded metal, such as aluminum, of sufficient strength and rigidity. The connector strip is formed in a squared S-shaped cross-section which provides an inner channel 31 whose inner wall is formed with a depressed, central, wall section 32. In addition, the connector strip has an outer channel 33. The two channels share a common wall 34. The outer wall 35 of the outer channel is provided with a pair of integral, rearwardly opening rear or bumper channels 36. Preferably, the free edges of the walls forming the bumper channels are provided with a hook-like configuration 37. The connector strips extend along the sides of the rear panel 14. In addition, an upper connector strip portion 38 extends along the upper edge of the rear panel, as illustrated in FIG. 5.

In the preferred embodiment illustrated in FIG. 8, the side edge flange 23 and the rear wall side flange or strip 25 are arranged in substantially the same plane, but are actually offset slightly one from the other. Thus, the flange 25 overlaps the flange 23. As shown in FIG. 7, the flange 25 slips into the outer channel 33 of the connector strip 30. The side wall edge flange 23 slips into the inner channel 31 of the connector strip 30. The channels 31 and 33 are deeper than the anticipated lengths of the flanges 25 and 23 that fit within them. Thus, as illustrated in FIG. 6, the flanges 23 and 25 do not fill their respective channels but rather are spaced from the bottoms of these channels. Consequently, considerable room is allowed to accommodate for inaccuracies in the dimensions of the side walls and rear wall of the cabana. That is, the depth of entry of the flanges into the respective channel can be adjusted to obtain the desired overall width dimension of the cabana. Moreover, the free edges of the flanges need not be carefully trimmed or squared. This substantially reduces the amount of labor that might otherwise be required for that purpose. Once the flanges 23 and 25 are inserted and frictionally held within their respective channels 31 and 33, rivets 39 may be applied to fix the parts together. (See FIG. 6.)

Figure 11:
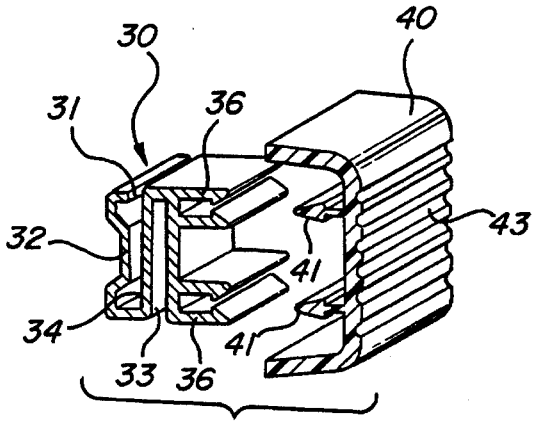
FIG. 11 is a fragmentary, cross-sectional and perspective view illustrating the wall connector strip with a bumper strip arranged in position for assembly thereto.

The connector strip is covered with a bumper strip 40. The bumper strip is made of a resilient plastic material, which is rubber-like in characteristics, and is generally U-shaped in cross-section. The bumper strip 40 is shown in assembled position, in FIGS. 6 and 12. FIG. 11 illustrates the bumper strip in position ready to be applied upon the connector strip.

The bumper strip 40 is held in place by integral prongs or tongues 41, that are arrow-head shaped, which fit into the bumper channels 36 on the connector strip 30. The arrow head prongs tend to interlock with the hooked ends 37 of the bumper channels to prevent removal of the bumper strip once they are inserted. The bumper strip is arranged to extend around and to cover the exposed portions of the connector strip. Thus, one of its purposes is to enhance the appearance of the rear of the cabana. Another purpose is to provide a resilient bumper to protect the cabana against damage due to impacts which occur during the transportation of the cabana to and from its sites of use. Normally, these cabanas are transported from one site to another, upon trucks. When a number of cabanas are carried upon a truck, there is a tendency for them to strike each other or the sides of the truck during the jolting of the truck. Thus, the bumper strips prevent damage.

The bumper strips 40 may include grooves 43 or indentation stripes. These grooves or stripes enhance the appearance of the bumper strips and also, may increase the resilient movement of the portions of the bumper strips that sustain impacts.

Figure 12:
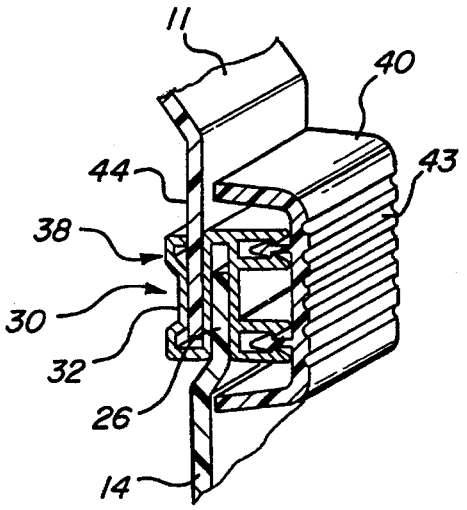
FIG. 12 is a fragmentary, cross-sectional view showing the assembly of the connector strip, the roof and rear wall flanges and the bumper strip.

As illustrated in FIG. 12, the cover or roof 16 of the cabana is provided with a rear, downwardly extended, flange 44. This flange fits into the inner channel 31 of the horizontal upper portion 38 of the connector strip. The upper flange 26 of the rear panel fits into the outer channel 33 of the horizontal portion 38 of the connector strip (see FIG. 12.)

FIGS. 9 and 10 illustrate a modified form of connector strip. This strip 45 is generally H-shaped in cross-section and is made of a suitable metal extrusion, such as aluminum, of sufficient strength for the purpose. Here, the strip is provided with opposed channels 45 into which the aligned flanges **23*a* and 24*a*** of the respective side and rear walls are inserted.

FIG. 10 shows the flanges arranged in a common plane rather than slightly offset from the same plane as illustrated in FIGS. 7 and 8. As illustrated in the drawings, the channels 46 are deeper than the portions of the flanges inserted into them so as to allow for variations in dimensions of the wall portions. Suitable rivets (not shown) may be used to fix the flanges within the channels.

Figure 13:
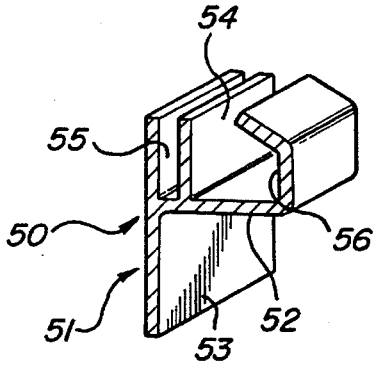
FIG. 13 is an enlarged, fragmentary, perspective view of the doorway strip.
Figure 14:
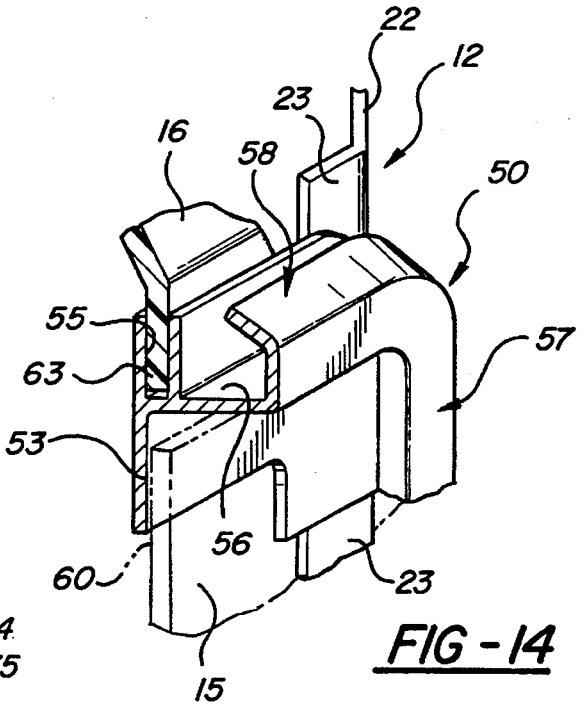
FIG. 14 is an enlarged, fragmentary, perspective view of a corner of the doorway defining strip illustrating a segment of the cover flange and side wall flange connected thereto and, in dotted lines, a door fitted therein.

Turning to the front of the cabana, the space between the opposed side wall flanges provides a doorway. The doorway is defined or outlined by a doorway strip 50. This strip is preferably formed of a metal extrusion, such as aluminum, which, as shown in FIG. 13, is T-shaped in cross-section to provide a head 51 and a stem 52. One side of the head provides a door stop flange 53. The other side of the head, along with an integral second flange 54, forms a channel 55. This channel receives the side wall forward flanges 23 (see FIG. 14). In addition, the stem part of the extruded strip is bent into a J-shaped cross-section to provide a water drain channel 56.

The doorway-defining strip is arranged to provide jamb portions 57 and a header portion 58 along the sides and top of the doorway. In addition, a sill strip 59 extends between and is fastened to the lower ends of the jamb portions 57. The sill strip may be made of a metal strip which is flat or is angled, in cross-section. Thus, the strip 50 provides a doorway outline or frame.

The door 15, may be provided with an edge flange portion 60. A suitable gasket or padding strip (not shown) may be arranged around the edges of the door. Also, the door may be formed of a pair of overlapped panels, joined together at their edges to provide a rigid door panel (not shown). The door is provided with hinges 61 for connecting it to one of the jamb forming members 57. In addition, a latch mechanism 62 (shown schematically) may be mounted upon the door for closing and locking the door when the cabana is in use.

The roof 16 is provided with a front edge flange 63 which is fitted within the channel 55 of the header portion 58 of the doorway defining strip 50. (See FIG. 14.) Rivets or the like may be used to secure the parts together.

The cabana base 11, preferably, is in the form of a pallet frame 65. The pallet frame may be molded of a suitable, strong, durable, plastic material and is hollow (see, for example, FIG. 15). As illustrated in FIG. 5, the base or pallet frame is preferably formed with a rear socket forming opening 66 and forward supports or struts 67. Integral skids or skid portions 68 are formed on the sides and lower surface of the base or pallet. These skids may have their lower surfaces provided with a series of beads or ribs 69 and 69*a* (see FIG. 15). Between the beads 69*a*, a plastic skid strip insert 70 may be positioned and fastened in place with suitable screws (not shown) so that the cabana unit may be slid upon the ground or upon a support surface. Thus, wear on the bottoms of the pallets of such cabanas is taken by the inserts and, in the event of undue wear or damage, the worn inserts 70 may be removed and replaced with new inserts.

The cabana is primarily designed as a housing for an outdoor toilet. Thus, as shown in FIG. 5, a static waste-receiving toilet tank 17 is arranged upon the base or pallet 11 over the rear open socket portion. The lower portion of the tank may be extended downwardly (not shown) to form a flat, pan-like portion 71 that fits within the open socket portion 66 to thereby stabilize the tank in position. A toilet opening 72 is provided on the upper surface of the toilet tank. A toilet seat and cover unit 73 is positioned over the toilet opening.

The forward portion of the pallet is covered with a rigid floor panel 74 which may be formed of plywood or sheet plastic or the like to provide a floor upon which an occupant may stand.

Figure 15:
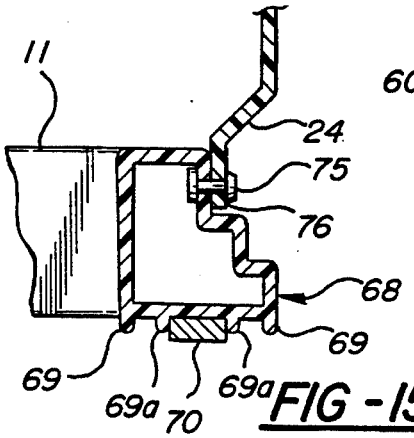
FIG. 15 is a cross-sectional view of a fragment of the base or pallet of the cabana with the lower edge of a side wall panel connected thereto.

The lower edge flanges 24 of the side walls of the cabana are fastened, such as by rivets 75 or screws or the like, to the sides, along side notches 76 formed on the base frame (see FIG. 15). The upper edges of the side walls are cut out to form depressions or elongated slots 80 (see FIG. 5) which may provide ventilation openings beneath the sides of the overlapping roof. The roof may be formed with integral box-like side edge sections 81 which overlap enlargements 82 formed on the upper edges of the side walls. The roof edge sections may be fastened to the enlargements by suitable rivets or the like (not shown).

In addition, the cabana may include a sink unit 85 of suitable design. This includes a sink or washing bowl 86 which may be mounted upon a support that can be used as a water tank 87 (see FIG. 5). A suitable water pump, such as a manually operated pump, can be installed for pumping water to the sink from the water tank. Alternative arrangements of the toilet and the sink units within the cabana may be used. Thus, the drawings and the disclosure herein illustrate one embodiment of this arrangement.

Figure 16:
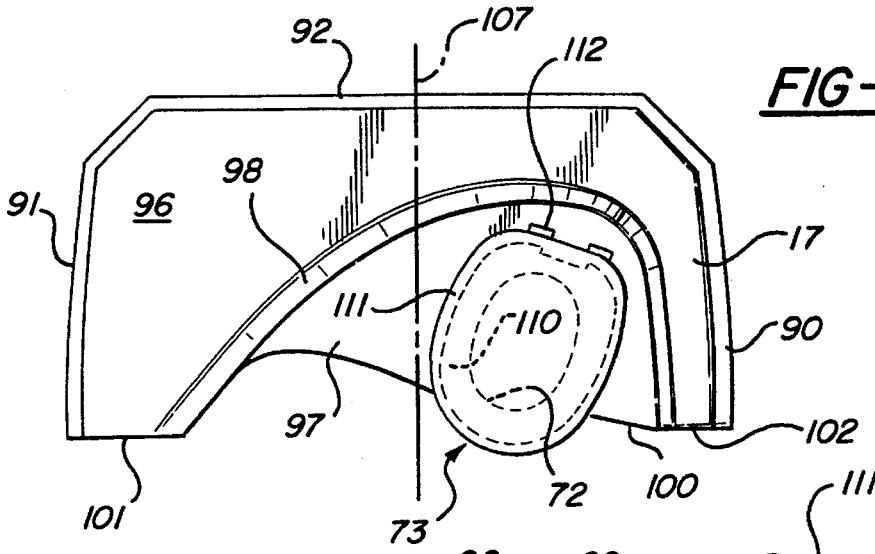
FIG. 16 is a top, plain view of the waste holding tank and toilet structure.

The combined toilet and waste material tank 17, in more detail, is formed with opposed side walls 90 and 91 and a rear wall 92. The side walls are preferably bowed or curved somewhat to closely match the interior surfaces of the cabana walls 12 and 13 (see FIGS. 16 and 18). In addition, the upper edges of the side and rear walls of the tank are formed with a notch 93 (see FIGS. 16 and 17) which receives a rubber-like gasket strip 94. The gasket seals the tank to the adjacent areas of the cabana walls (see FIGS. 18 and 19).

The bottom panel 95 of the tank (see FIG. 19) is formed with the depressed, shallow, flat pan-like portion 71, mentioned previously. Thus, the area of the bottom which surrounds the pan-like depression, provides a ledge which rests upon the upper surface of the portions of the base which define the open socket 66 of the base. This is shown schematically in FIG. 19.

The tank is closed with an upper, closure panel 96 which has a depressed portion 97 integrally connected to the main body of the upper panel by an integral flange-like strip 98. In addition, the tank has a front wall 99 having a middle portion 100 which is angled relative to opposite side portions 101 and 102 of the front wall 99.

The toilet 72 has a forward, partial bowl-like portion 105 which extends forwardly of the middle portion 100 of the front wall.

Figure 18:
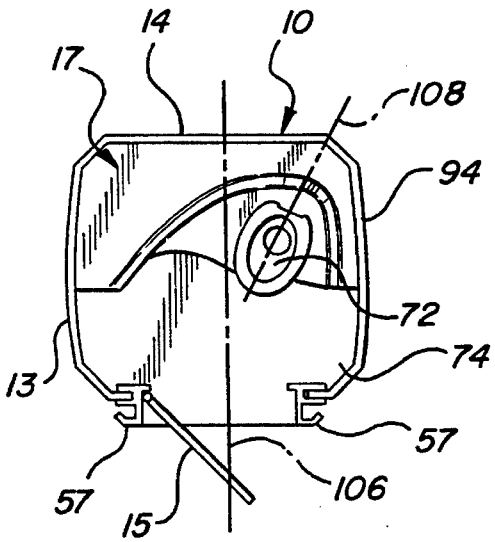
FIG. 18 is a schematic, plan view, in cross-section, of the cabana and the holding tank and toilet structure positioned within the cabana, drawn to a reduced scale.
Figure 19:
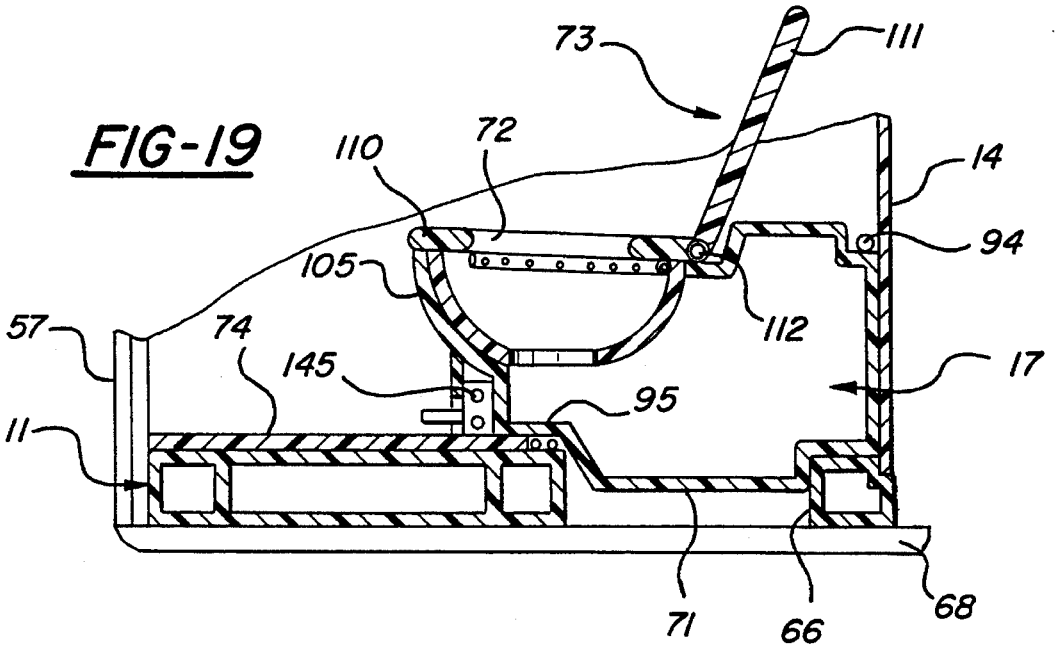
FIG. 19 is an enlarged, cross-sectional view showing the holding tank and toilet structure, illustrated schematically, positioned within the cabana.
Figure 20:
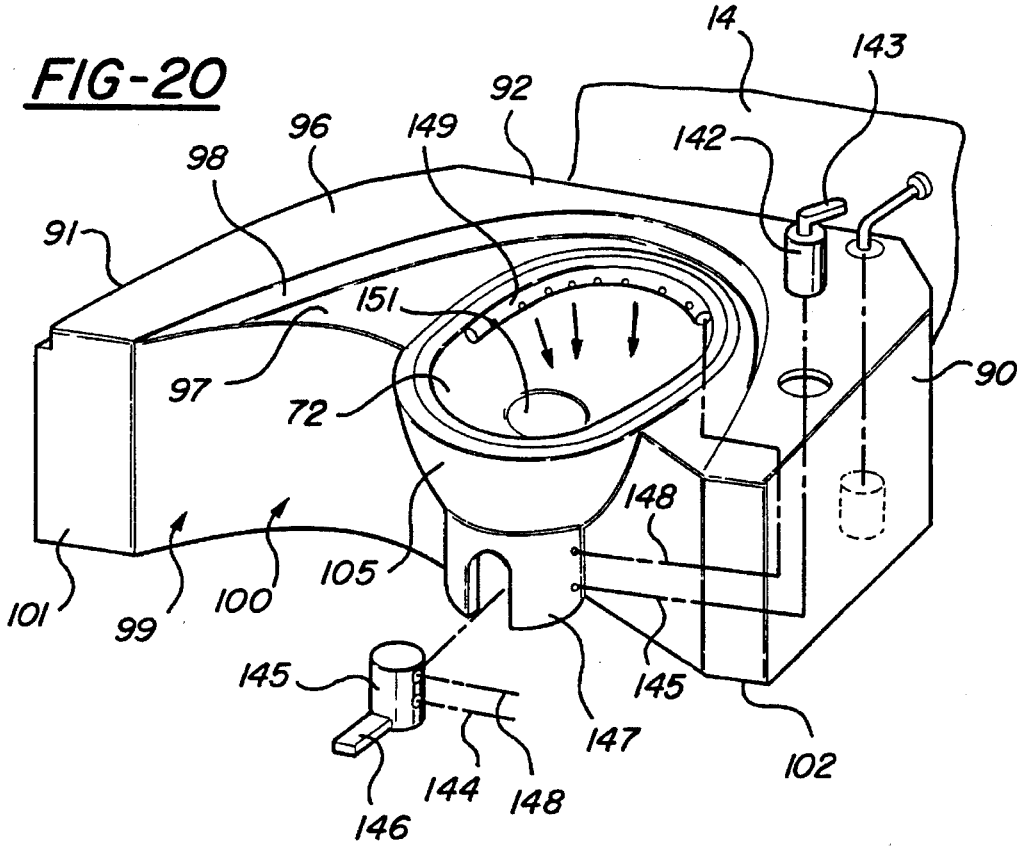
FIG. 20 is a perspective view of the tank and toilet structure with the plumbing pipes and pump parts illustrated schematically.
Figure 21:
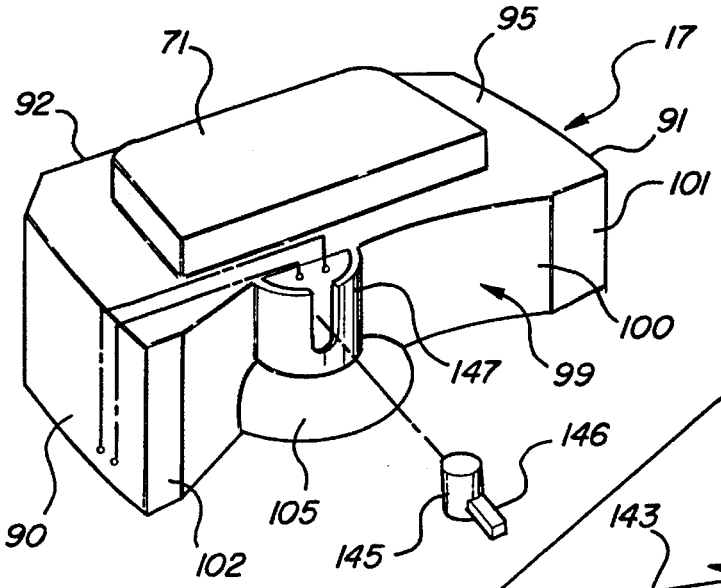
FIG. 21 is a perspective view showing the toilet structure and holding tank in an upside down position and the schematically shown pump dissembled therefrom.
Figure 22:
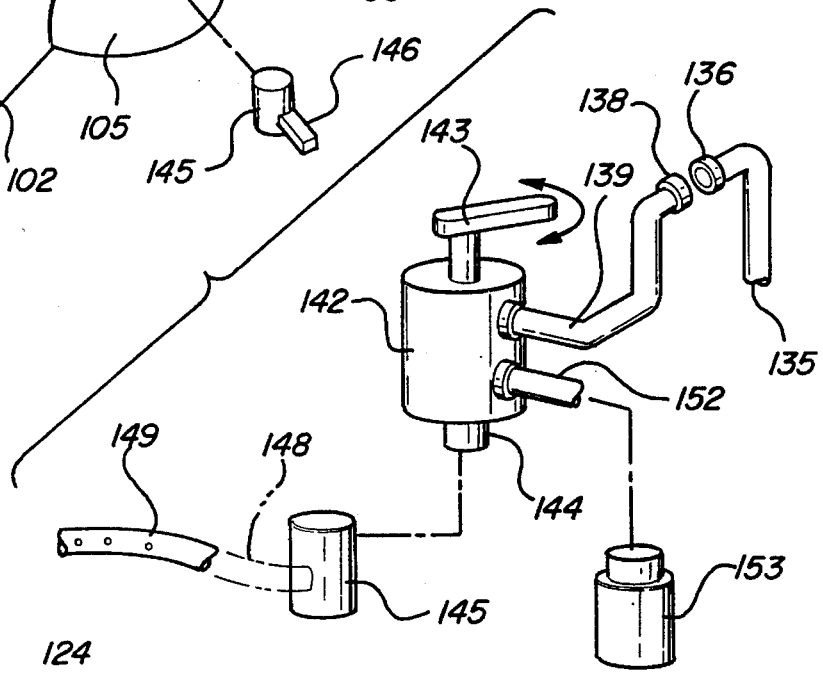
FIG. 22 is a schematic diagram showing the water flow system through the control valve and pump.
Figure 23:
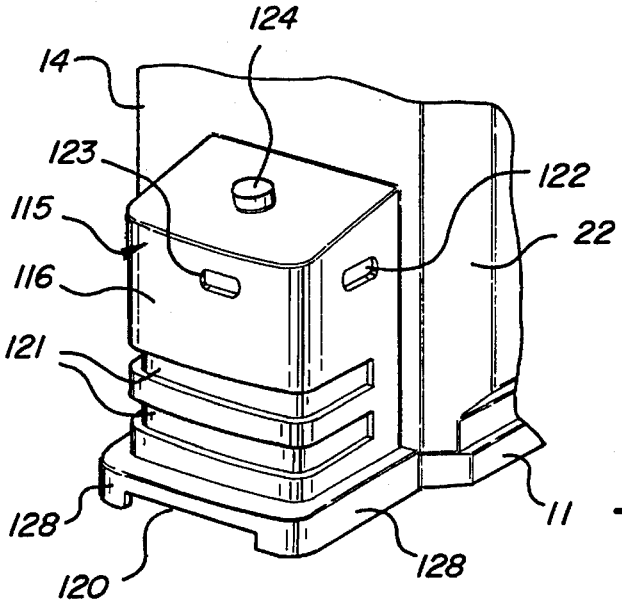
FIG. 23 is a perspective view of the rear of the fresh water tank arranged against the rear wall of the cabana.
Figure 24:
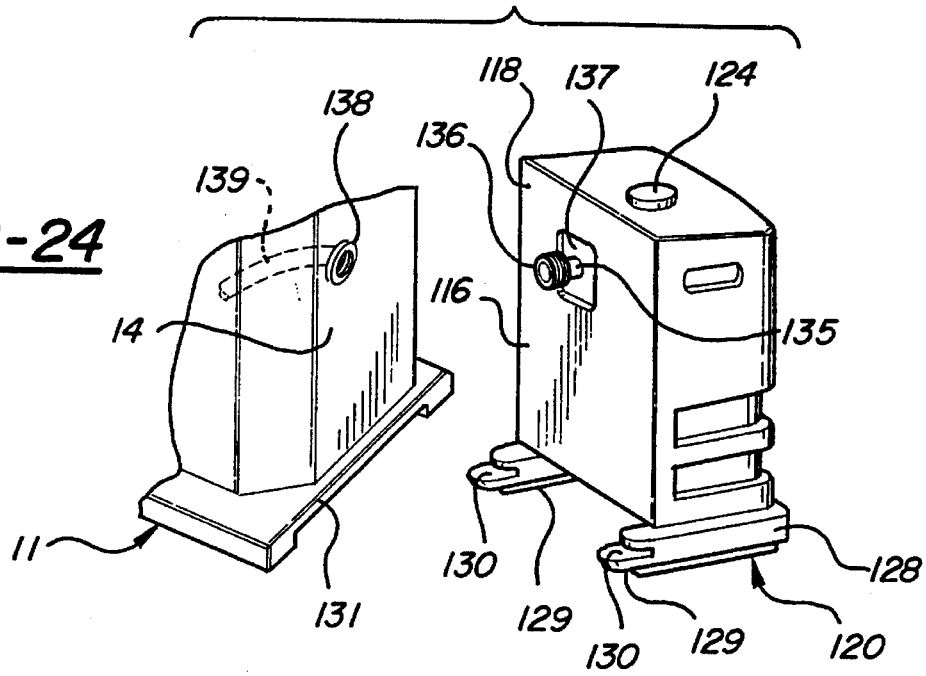
FIG. 24 is a fragmentary view of the rear wall of the cabana and of the base with the fresh water tank moved away from the cabana.
Figure 25:
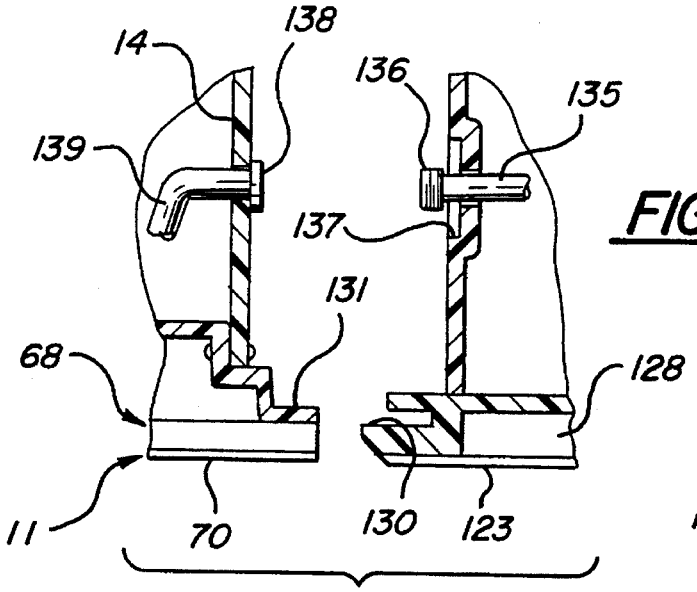
FIG. 25 is a fragmentary, schematic view showing the connections between the fresh water tank and the rear lower portion of the cabana.
Figure 26:
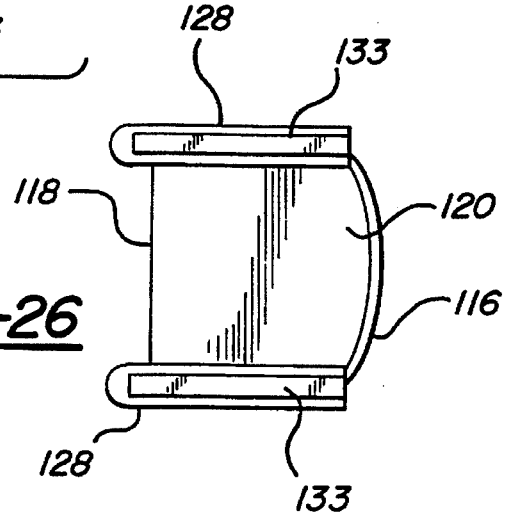
FIG. 26 is a view of the bottom of the fresh water tank.

As shown in FIGS. 18 and 20, the cabana has a front to rear central axis 106 which bisects the cabana into two opposite sides. Similarly, the tank has a corresponding central axis 107 which is in alignment with the cabana axis 106.

The toilet, however, has a central axis 108 (see FIG. 18) which is angled to intersect the central cabana and tank axes 106 and 107 at an acute angle. The middle section 100 of the front wall is approximately perpendicular to the axis 108 of the toilet so that it is angled relative to the axes 106 and 107.

Thus, the forward-most portion of the bowl-like portion of the toilet is roughly in the plane of the side portions 101 and 102 of the front wall 99 of the tank. The distances from the forward-most point of the bowl-like portion of the toilet to the surface of the middle wall section 100, are approximately equal on both sides of the toilet.

Figure 17:
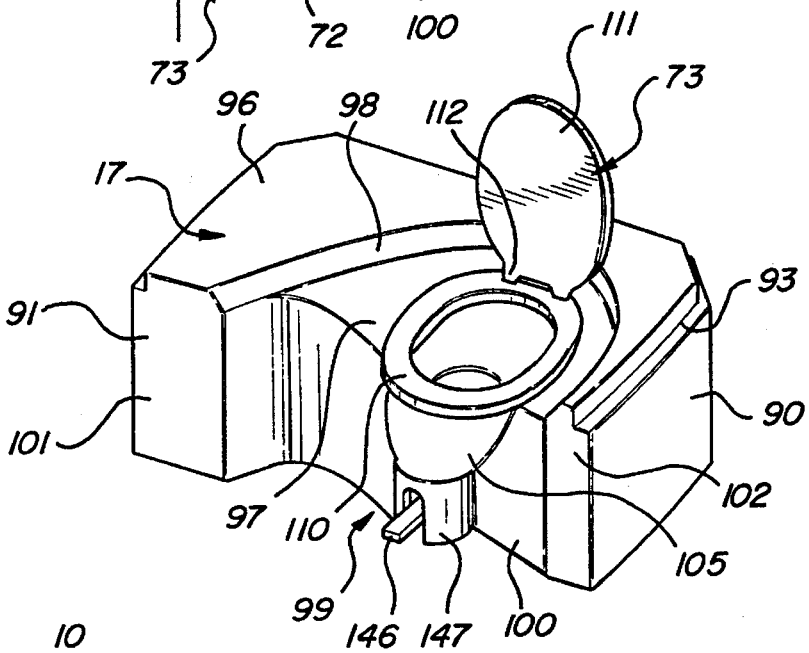
FIG. 17 is a perspective view illustrating the waste holding tank and toilet structure, with the toilet cover swung into the open position.

The toilet seat-cover unit 73 may be formed of a conventional toilet seat 110 and a suitable, correspondingly shaped and sized cover or lid 111. The cover and lid are connected together and to the tank by conventional hinges 112. Thus, for use, the toilet lid 111 may be swung upwardly, as illustrated in FIG. 17, to expose the seat 110. The partial bowl-like extension of the toilet, extending forwardly and spaced on either of its sides approximately equidistantly from the front wall section with which it is joined, makes the toilet more user friendly for both males and females. This arrangement makes it possible to eliminate a separate urinal which would otherwise be conventionally mounted within the cabana. Hence, the toilet arrangement is intended to be unisex and is convenient and comfortable for use by either gender.

The tank may be periodically cleaned by inserting the end of a pipe through the toilet opening into the tank and connecting the opposite end of the pipe to a waste removal truck for pumping out the contents of the tank. This is a conventional system for cleaning toilets of this type.

When the cabana, whether fully assembled or in a disassembled or knock-down form, is to be transported from one site to another or is to be stored, the waste tank may be removed from the cabana and transported as a separate component.

Referring to FIGS. 23–26, the water tank 115 is a separate unit which may be arranged against the rear wall 14 of the cabana. The tank has a forward wall 116 which is normally arranged in close proximity to the outside surface of the cabana rear wall 14. In addition, the tank has side walls 117 and a rear wall 118 with a cover 119 and a base 120. The side and rear walls are formed with indentations 121 which provide an attractive decorative appearance and, moreover, provide a structural reinforcement of the relatively thin wall of plastic sheeting which forms the tank.

To assist in moving the tank hand grip indentations 122 are formed in the side walls and a front wall hand grip indentation 123 is also provided. These indentations are of sufficient length and depth to accommodate the fingers of a human hand for lifting and moving the tank.

The tank normally is moved from site to site in empty condition and upon being positioned adjacent the rear of the cabana, is filled with fresh water through a fill hole and cover 124.

The tank base 120 is provided with a pair of support skids 128. These skids extend forwardly into bifurcated forward extension portions 129 which provide notches or grooves 130. These notches or grooves receive the rear bar portion 131 of the base 11. Thus, when the base-bar portion is fitted into the pair of notches 130 of the water tank skids, the tank is stabilized against movement and rests upon the same ground surface upon which the cabana rests.

Since the water tank may be moved about from time to time, its skids are provided with bottom skid plates 131 which may be formed of strips made of a suitable plastic material that are fastened to the lower surfaces of the skids by screws or the like. Thus, the skid plates are removable and replaceable in the event that they become worn.

A pipe 135 extends into the water tank and is provided with a conventional pipe coupling 136 located in an indentation 137 in the forward wall of the water tank. This coupling engages and is releasibly coupled to a corresponding pipe coupling 138 extending from the wall 14 of the cabana. The coupling 138 is connected to a fresh water pipe 139 which extends into the cabana and downwardly into the waste material tank through an opening 140 in the upper surface of that tank 17.

The fresh water pipe 139 is connected to a control valve 142 which may be provided with a manually operable control valve handle 143. In turn, the control valve is connected to supply pipe 144 which extends within the waste material tank or, alternatively, along the outside of the waste tank to a manually operable pump 145. The pump is provided with a manually operable foot lever which powers the pump by moving the lever 146 up and down by foot pressure. The pump is arranged within a bulged housing 147 formed at the front of the tank and beneath the toilet bowl extension 105.

The pump is connected to a flush water pipe 148 which extends into the toilet structure and is connected to a flush mechanism 149. This mechanism may include a perforated ring or tube arranged along the upper portion of a separate toilet bowl insert 150 which is positioned within the bowl 105. The bowl insert has a lower opening 151 through which waste material may be deposited.

The bowl insert opening 151 may be provided with flap-type covers or the like (not shown) which normally close the opening and which open during flushing. Various types of commercial available mechanisms can be used for this purpose and, therefore, a detailed mechanism is not illustrated here. Rather, any suitable closure mechanism may be used or, alternatively, the opening may be left without a closure.

An alternative source of liquid for flushing is obtained through a waste tank pipe 152 which is connected through a filter 153 into the lower portion of the waste material storage tank. This waste tank pipe 152 is also connected to the control valve 142 and through the control valve to the flush water pipe 147 which extends to the flush ring or tube 148.

The control valve, which may be a conventional plumbing water control valve, may be adjusted, by turning its control handle 143, to permit the flow of liquid either from the fresh water tank 115 or, alternatively, from the liquid taken from the waste material storage tank. In either event, the liquid passes to the pump 145 and from the pump through the flush water pipe 148 to the flushing ring 149. Hence, liquid may be normally obtained from the fresh water tank when the fresh water tank is used and contains fresh water. When those conditions are not met, liquid may be obtained from the waste material storage tank.

Where desired, the flush mechanism may be disabled completely by turning the control valve handle 143 into a position where no liquid passes through it to the pump. In that event, the system operates as a static, gravity drop waste collection tank system with no flushing.

As can be seen, with this flushing system, the toilet unit may be used either with or without the fresh water tank or fresh water from the tank. Thus, where not feasible, the fresh water tank can be omitted from the installation. Significantly, where the tank is used, when the fresh water is completely withdrawn from the fresh water tank, the flush mechanism can be switched to utilize liquid from the waste tank until such time as the fresh water is replenished.

The amount of water contained in the fresh water tank should be less than the amount of storage capacity of the waste material storage tank to avoid overfilling or overflowing the waste material tank. However, a considerable amount of fresh water may be stored became the water is positioned in a storage tank outside the cabana so that the limited space within the cabana is not reduced by the storage of fresh water.

This invention may be further developed within the scope of the following claims. Thus, having fully described at least one operative embodiment of this invention;

It is now claimed:

1. A flush system for an outdoor portable toilet having a cabana formed of a base for supporting the cabana upon a ground-like surface and connected with side and rear walls and a front portion having a doorway with a door, and having a waste material holding tank arranged upon the base adjacent said walls, and with a toilet structure positioned on the tank and opening into the tank for depositing toilet waste therein, comprising;

an actuatable flushing mechanism for flowing flushing liquid through the toilet structure when actuated so that the liquid may move toilet waste from the toilet structure into the waste holding tank;

a separate, closed, fresh water tank positioned on the outside of the cabana, with the tank having a forward wall arranged in close proximity to a cabana wall, and with the tank having a bottom upon which supports are provided for supporting the tank upon the ground-like surface upon which the cabana is supported;

a fluid carrying pipe connected to the water tank and having a disconnectable coupling through which the pipe is connected to the flushing mechanism for providing flush liquid from the water tank to the flushing mechanism when said mechanism is actuated;

said water tank being refillable with fresh water, when desired, and having a water containing capacity which is less than the volume of the holding capacity of the waste material holding tank;

whereby the waste holding tank may be emptied and the water tank refilled at approximately the same time, so that transferring water from the water tank, through the flushing mechanism, into the holding tank will not overfill the holding tank.

2. A flush system as defined in claim 1, and including a waste liquid pipe extending into the waste holding tank and connected, through a filter, with the liquid contained in the waste holding tank, so that liquid may be drawn for filtering and for flowing to the flushing mechanism through the waste liquid pipe;

a control valve for controlling the flow of liquid into the flush mechanism;

said waste liquid pipe having an opposite end connected to said control valve;

said fresh water tank fluid pipe also being connected to the control valve, and said control valve being manually operable to selectively connect either the fresh water pipe or the waste liquid pipe to the flush mechanism for selectively using liquid drawn from either the fresh water tank or from the waste holding tank for flushing the toilet structure.

3. A construction as defined in claim 2, and said control valve having a control position for shutting off the flow liquid to the flushing mechanism, so that toilet waste may be statically deposited into the waste holding tank without flushing.

4. A construction as defined in claim 3, and including said flushing mechanism having a liquid inlet section connected with a manually operable pump for drawing flushing liquid from said pipes for manually pumping liquid through the flushing mechanism from whichever pipe is selectively connected through said valve to the flushing mechanism.

5. A construction as defined in claim 1, and said cabana base having a rear, bar-like portion extending horizontally beneath the cabana rear wall, with said portion being normally elevated at short distance above a support surface upon said base is supported;

and with the fresh water tank supports having first forward extensions arranged to engage with said base portion and to fit between said base portion and the support surface.

6. A construction as defined in claim 5, and said fresh water tank supports including second forward extensions arranged above the first forward extensions for normally holding said cabana bar-like portion between said first and second support extensions, whereby the fresh water tank may be stably held in a position with its forward wall against the rear wall of the cabana and the fresh water tank may be moved rearwardly from the cabana and removed therefrom, when desired.

7. A construction as defined in claim 6, and said fresh water tank supports being in the form of a pair of spaced apart skids arranged upon the bottom of the fresh water tank;

said skids having lower surfaces for resting upon the ground-like support and the skids having forward extensions which have bifurcated ends for fitting above and below the base bar-like portion and for frictionally substantially holding the skids to the base.

8. In an optionally flushable outdoor portable toilet construction including a cabana with a base, closure walls and an entry doorway with a door closure, and containing a waste material holding tank with a toilet structure opening into the tank for deposit of waste materials directly into the tank from which accumulations of such wastes may be removed from time to time, the improvement comprising;

a selectively actuatable flushing mechanism for flowing flushing liquid through the toilet structure when actuated for flushing toilet waste into the waste holding tank;

a separate and removable fresh water storage tank arranged on the exterior of the cabana in close proximity with a wall thereof, and with the water storage tank having a usable water volume holding capacity which is less than a pre-determined waste volume holding capacity of the waste tank;

a disconnectable pipe connecting the fresh water storage tank to a control valve which, in turn, is connected to and controls the flow of liquid to a liquid intake of the toilet flushing mechanism;

a waste water liquid pipe connected to said control valve and extending into the waste water tank and connected with a filter for drawing filtered liquid from the waste water tank to said control valve;

said control valve having selectively settable positions to alternatively permit the flow of liquid from either the water storage tank or the waste water tank pipes or neither, as desired;

a pump for drawing liquid from the control valve and the pipe connected through the control valve, to the flush mechanism, for flushing the toilet structure, when desired;

whereby the toilet structure may be flushed with either fresh water or with filtered liquid waste water, such as when fresh water is lacking, without overfilling the waste material storage tank and, alternatively, the toilet may be used without flushing.

9. A toilet construction as defined in claim 8, and including said fresh water storage tank being supported upon support skids having forward extension portions;

said cabana base having a rear portion extending beneath the cabana and spaced above a support surface upon which the cabana is rested;

said forward extension being frictionally engaged with said base portion for normally holding the fresh water tank to the cabana.

10. A toilet construction as defined in claim 8, and said fresh water tank supports being in the form of spaced apart skids extending beneath the fresh water tank for supporting it upon a support surface and having end portions extending forwardly of the tank, beneath the rear wall of the cabana and being removably engaged with said cabana portion.

* * * * *